US007533916B2

(12) United States Patent
Eichenbaum

(10) Patent No.: US 7,533,916 B2
(45) Date of Patent: May 19, 2009

(54) ITEM CARRYING DEVICE

(76) Inventor: Mark Eichenbaum, 5 Glenwood Ave., Augusta, ME (US) 04330

( * ) Notice: Subject to any disclaimer, the term of this patent is extended or adjusted under 35 U.S.C. 154(b) by 193 days.

(21) Appl. No.: 11/473,703

(22) Filed: Jun. 23, 2006

(65) Prior Publication Data

US 2007/0296233 A1 Dec. 27, 2007

(51) Int. Cl.
*B65D 33/06* (2006.01)

(52) U.S. Cl. ..... 294/159; 294/170

(58) Field of Classification Search ..... 294/137, 294/159, 170; D9/434, 455; 16/422, 425
See application file for complete search history.

(56) References Cited

U.S. PATENT DOCUMENTS

| | | | | |
|---|---|---|---|---|
| D314,150 | S | 1/1991 | Preciutti | |
| D340,863 | S | 11/1993 | Daigle | |
| D362,622 | S | 9/1995 | Van Davelaar | |
| D363,024 | S * | 10/1995 | Martinez | D9/434 |
| 5,487,581 | A | 1/1996 | Carmo et al. | |
| 5,797,166 | A * | 8/1998 | Wagenheim | 16/443 |
| D400,785 | S * | 11/1998 | Randall | D9/434 |
| 5,836,634 | A | 11/1998 | Finkleman | |
| 5,855,403 | A * | 1/1999 | Harper | 294/158 |
| D469,015 | S | 1/2003 | Le Roux | |
| 6,511,114 | B1 | 1/2003 | Fludd | |
| D489,618 | S * | 5/2004 | Startek | D9/455 |
| 6,883,207 | B2 | 4/2005 | Le Roux | |
| 7,024,730 | B2 | 4/2006 | Scholes | |
| 2003/0102683 | A1 | 6/2003 | Graham | |
| 2004/0201236 | A1 | 10/2004 | Adelson | |

FOREIGN PATENT DOCUMENTS

GB 2 123 280 * 2/1984

* cited by examiner

*Primary Examiner*—Dean J Kramer
(74) *Attorney, Agent, or Firm*—Verrill Dana, LLP; Chris A. Caseiro

(57) ABSTRACT

A durable carrying device for transporting multiple items. The carrying device has a plurality of holding members that are capable of securely holding several heavy items, such as plastic bags filled with consumer goods, for easy carrying by a user of the device. The holding members specifically are arranged such as to hold the items closely to one another to minimize swinging of the items as they are being carried. Further, the carrying device includes a comfortable handle that allows the user to carry items with reduced discomfort to the hand. The durable construction of each of its elements and of its overall structure allows the carrying device to withstand the rigors associated with item carrying. The seamless design of the carrying device and the smooth finish of its surface make it easy to clean.

9 Claims, 1 Drawing Sheet

ITEM CARRYING DEVICE

BACKGROUND OF THE INVENTION

1. Field of the Invention

The present invention relates to item carrying devices. More particularly, the present invention relates to handheld item carrying devices that are capable of holding multiple items. Still more particularly, the present invention relates to lightweight, but durably constructed, handheld item carrying devices that are capable of securely holding multiple items, such as shopping bags, for comfortable and easy transport by an individual.

2. Description of the Prior Art

In the hustle and bustle of our busy lifestyles, we frequently need to transport multiple heavy items from one location to another. For example, consider a typical trip to the supermarket or other consumer goods store in which a shopper fills up a cart with many products. Once those products are paid for and placed into several bags, the shopper is left with the unpleasant task of having to transport the bags home. Indeed, for those who love to shop, nothing spoils the shopping experience more than having to carry several heavy bags from the checkout line to the car, and then from the car to the home. For those who hate to shop, this bag transporting burden only worsens the shopping experience. Further, when bags must be carried by an individual for an extended period of time, such as when a person walks home from a supermarket or a shopping mall, the bags quickly become cumbersome to carry.

To make bag carrying easier, most bag manufacturers have built handles into the design of their bags. While these handles have made bag carrying easier, they have not necessarily made bag carrying easy. One of the primary complaints of those who engage in the common practice of carrying several heavy bags is that the handles of the bags exert great pressure on their hands. Sometimes this pressure is so substantial that the bags bruise, or even cut into, the skin. Those wishing to avoid sore hands therefore may be forced to carry no more than one or two bags per hand at a time. Carrying only a few bags at a time, however, can be an inconvenient practice, especially when doing so means having to make more trips. For drivers, this typically means making more trips between the car and the house. Worse, for walkers, this typically means having to make more trips to and from the store.

Bags can be difficult to transport even when they are not being carried by an individual, such as when they are being transported in a vehicle. When plastic bags are used, for example, the items that they contain often tend to be freed from the bags and jostled about a vehicle as they are being transported from market to home. In some cases, this leads to eggs being cracked, the top of a bleach bottle being broken and bleach being spilled, and to the occurrence of other similarly irritating, if not hazardous, events. In anticipation of these events, some drivers even elect to alter their driving habits to prevent them from occurring.

Attempts have been made to make bag carrying easier. For example, U.S. Pat. No. 5,487,581 to Carmo et al. describes a hand grip for carrying bags which contains a single hook for holding the bags. Other U.S. patents show devices similar to that of Carmo et al. Specifically, U.S. Pat. No. 6,511,114 to Fludd, U.S. Pat. No. 6,883,207 and D469,015 to Le Roux, D314,150 to Preciutti, D362,622 to Van Davelaar, D340,863 to Daigle and U.S. Patent Publication No. 2004/0201236 to Adelson all describe a bag carrying device having a handle and one or more hooks upon which bags may be placed. All of these devices, however, are substantially limited in at least two ways. First, none of these devices has an effective means for keeping bags on their hook or hooks. Therefore, bags loaded on any of these devices may easily become freed from their hooks whenever the device is set down, such as when a shopper places the bags into a vehicle's trunk for transport. Such inadvertent unloading is problematic because a bag that is freed from its hook is more likely to release its items than is a bag that remains secured to its hook. Furthermore, a bag loaded onto a hook of any of these devices also is prone to being accidentally unloaded from the hook even while the user is carrying the device, such as when the user runs to catch a bus or gets one or more bags entangled around the end of a stairway railing.

Second, these devices are limited because each of their handles is made of a hard material and is of a relatively narrow design. Therefore, even when few, or even no, bags are loaded onto one of these devices, the hard, narrow handle makes the device uncomfortable to grip. Even worse, the device becomes increasingly more uncomfortable to grip as the weight that it holds is increased.

Some of these devices are further limited because they are incapable of carrying more than a few bags. This is true because some of the devices, namely those of Carmo et al., Le Roux, and Adelson, contain only one or two hooks.

Another attempt to make bag plastic bag carrying easier is evidenced by the device described in U.S. Pat. No. 5,836,634 to Finkleman. Finkleman's device is described as being a "hanger unit" having hooks that include clip elements. Like the devices described above, Finkleman's device also has substantial limitations.

One of the most substantial limitations of the Finkleman device is that it is specifically designed to prevent the bags that it holds from interfering with each other when they are being carried by the user. In other words, bags carried by the Finkleman device are meant to swing freely. A bag carrying device that allows its bags to swing freely is undesirable in many respects, however. Generally this is true because free swinging bags are more difficult to carry than are bags that are held stationary, or substantially stationary, with respect to the carrying device. This is also true because freely swinging bags are more likely to release their contents than are bags that do not substantially swing. Further, items in a freely swinging bag are more likely to collide inside the bag, and therefore are more likely to become damaged, than are those in a bag that does not swing. By requiring such free swinging, the Finkleman device therefore frustrates the very goal that the bags are meant to achieve, which is to safely and conveniently hold items.

In addition to being difficult to the problems that are caused by allowing its bags to swinging freely, the Finkleman device is further limited in that each of its hooks is designed to carry only one bag at a time. Therefore, the Finkleman device is limited to being used to carry only a few bags, which means that individuals having to carry several bags at once either would need to carry two of the Finkleman devices, one for each hand, to fully satisfy their bag carrying needs. This would be undesirable because it would not leave the user with a free hand for performing tasks that people are prone to do while carrying bags, such as opening a car door, reaching into a pocket for bus change, or making a call on a cell phone. In cases where two of the Finkleman devices would not be enough, prospective users would be forced to choose between making multiple trips and not using the device altogether.

Another limitation of the Finkleman device is that it is not optimally durable. That is, it is not one solid, integral unit, but instead is comprised of multiple thin pieces which come together to form the whole device. This thin, streamlined construction makes the device particularly susceptible to breakage and to unwanted flexing. When broken, the utility of the device is compromised, if not eliminated altogether.

Another limitation of the Finkleman carrying device is that it is not optimally designed to allow its user to add or remove bags from its clip elements while the device is being held by the user. This problem is attributed to a few design flaws. First, the device is relatively large as compared with the frame of an average-sized individual. Second, the need to accommodate several clip members and to space them such that bags hanging from them do not touch when being carried means that some of the clip members, and particularly the clip members positioned at both extreme ends of the device, are inconveniently too far in front of, or in back of, the individual during normal carrying. Third, the device, as mentioned before, is thin and flexible.

In combination, these design flaws effectively force an individual carrying bags with the Finkleman device, such as during normal use, to maneuver the device awkwardly in order to access the clip members, and particularly the clip members at the extreme ends of the device. Specifically, due to the device's relatively large size, the clip members are not easily reachable when the device is held at arm's length to the individual's side, as an individual would be expected to hold it during normal use. Further, to reach a clip member at one end of the device, the individual would need to swing that end from a position far removed from his person to a position closer to his person. Invariably, this repositioning would require having to grab the device at or near its end having the clip member of interest. Further, holding the device by this one end would mean that the other end would be left to dangle away from the individual. Since the device is thin and highly flexible, any such dangling would be particularly pronounced. Pronounced dangling of this end would be particularly undesirable where the dangling end holds a bag, namely because the weight of the bag would cause the end of the device having the clip member of interest, and the device itself, to pull away from the individual as he attempts to access that clip member. This weighted pulling, in conjunction with the increased flexibility of the device, would cause the end being gripped by the user to torque within the user's hand, which, in turn, would cause overall unsteadiness within the device. For this reason, the only practical way for a user of the Finkleman device to access certain clip members would be to first set the device down. However, where the device is being used in certain locales, such as on packed subway cars or while riding on an escalator, for example, it would not be practical, or perhaps even possible, to set the device down.

Yet another limitation of the Finkleman device is that like the devices described above, the grip of its handle is not optimally designed to provide the user with maximum comfort. The Finkleman device has a hard handle which includes several grooves. The hardness of the handle provides its user no cushion to protect the user's hands against the strain of carrying heavy items. Further, these grooves may be hazardous to some users. For example, grooves that are designed to accommodate the hands of an average sized adult may be likely to pinch the digits of small children or the frail, such as some elderly individuals.

The Finkleman device is also limited in that it is difficult to keep clean. Indeed, there are numerous crevices present on its entire surface. These crevices provide areas for dust, dirt, grease and grime to collect. Build-up of such materials is unsanitary, and therefore poses a health hazard, especially where the device is being used to carry bags containing food. This is particularly troublesome because due to the contours of the grooves, a quick wiping of the device with a cloth and a cleanser would be insufficient for removing such undesirable deposits of filth. For this reason, thorough cleaning of the Finkleman device would require extensive time and effort, and perhaps even special cleaning equipment. For the busy shopper, this would create an undue burden. Instead of taking the time and effort to clean the device, many therefore would elect to take the environmentally unfriendly path of throwing the device away in favor of a new one.

What is needed therefore is a bag carrying device that is durably constructed and capable of carrying several heavy bags. Further, what is needed is a bag carrying device that is capable of carrying several bags securely without risk of having the bags becoming accidentally freed from the device, that holds the bags together while they are being carried such that swinging of the bags is kept minimal, and that is easy to load and unload while it is being carried. Even further, what is needed is a bag carrying device that keeps the handles of each bag held together, thereby preventing the items contained in each bag from falling out both while being transported in a vehicle, such a car's trunk, or even set to rest on a stationary surface, such as on a bus stop bench. Further still, what is needed is a bag carrying device that is comfortable to grip and is easy to clean and maintain.

SUMMARY OF THE INVENTION

It is an object of the present invention to provide a device for carrying a plurality of items, such as shopping bags. It is another object of the present invention to provide a device that will allow the plurality of items being carried to make contact with each other such that they are prevented from swinging, or are essentially prevented from swinging. It is a further object of the present invention to provide a device for carrying items that will not cause damage to the hands of its user while it is being used. It is another object of the present invention to provide a carrying device that may be easily loaded and unload while it is being held by its user. It is yet another object of the present invention to provide an item carrying device that is durably and seamlessly constructed, to allow it to withstand the rigors that accompany the carrying of multiple items and to facilitate cleaning of the device, respectively. Where the device of the present invention is being used to carry bags, it is an object of the present invention to ensure that the bags are held closed to prevent the contents of the bags from spilling.

These and other objects are achieved by the present invention, which is an improved item carrying device. The item carrying device includes a frame formed by four linear sections, such that the frame has an opening. Affixed to one of the sections is a plurality of holding members and a plurality of flexible tines, such that each holding member has its own flexible tine at or near contact with it. The purpose of each holding member is to hold one or more items, and the purpose of each tine member is to prevent the one or more items from accidentally being unloaded from the holding member.

Attached to another section is a cushioned handle. The positioning of the cushioned handle allows the user of the device to hold the device such that the user's hand may be within the opening of the frame. The cushioning of the handle makes the device comfortable to the user to hold, and effectively prevents the user's hand from being harmed while carrying heavy loads with the device.

The device is durably and compactly constructed of a strong material. The device is thickly crafted and its outer surface has a smooth finish. Further adding to the durability of the device is that its elements are seamlessly or integrally connected, such that the device is formed essentially as a single piece. This durable construction allows the device to be dropped, bumped, run over with a vehicle, etc., which are all events that may occur with normal use of the device, with little or no harm to the device. This durable, compact construction further means that the device is easily manipulated, such as for loading or unloading items, while it is being carried by its user.

Furthermore, since the device is preferably formed as a single piece, and since the surface of the device is smooth, and containing no, or essentially no, crevices, the device is easy to clean. Since it is easily cleaned, owners of the device will need not waste valuable time and effort cleaning it, and will not be tempted to wastefully dispose of it solely because it is dirty and, therefore, unattractive.

The details of one or more examples related to the invention are set forth in the accompanying drawings and the description below. Other features, objects, and advantages of the invention will be apparent from the following description and accompanying drawings, and the appended claims.

DETAILED DESCRIPTION OF THE PREFERRED EMBODIMENT

Figure 3:
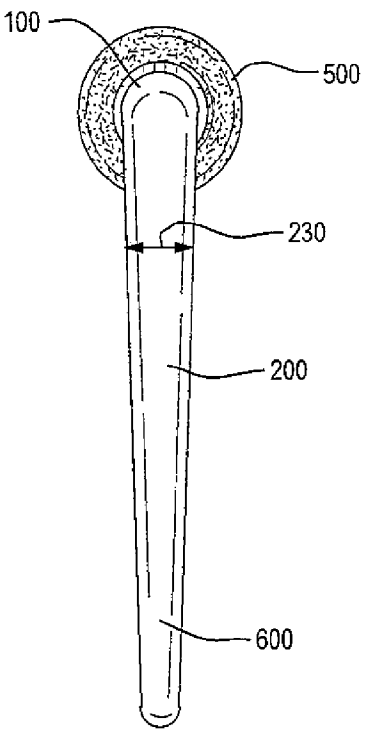
FIG. 3 is an end view of the preferred embodiment of the present invention.
Figure 1:
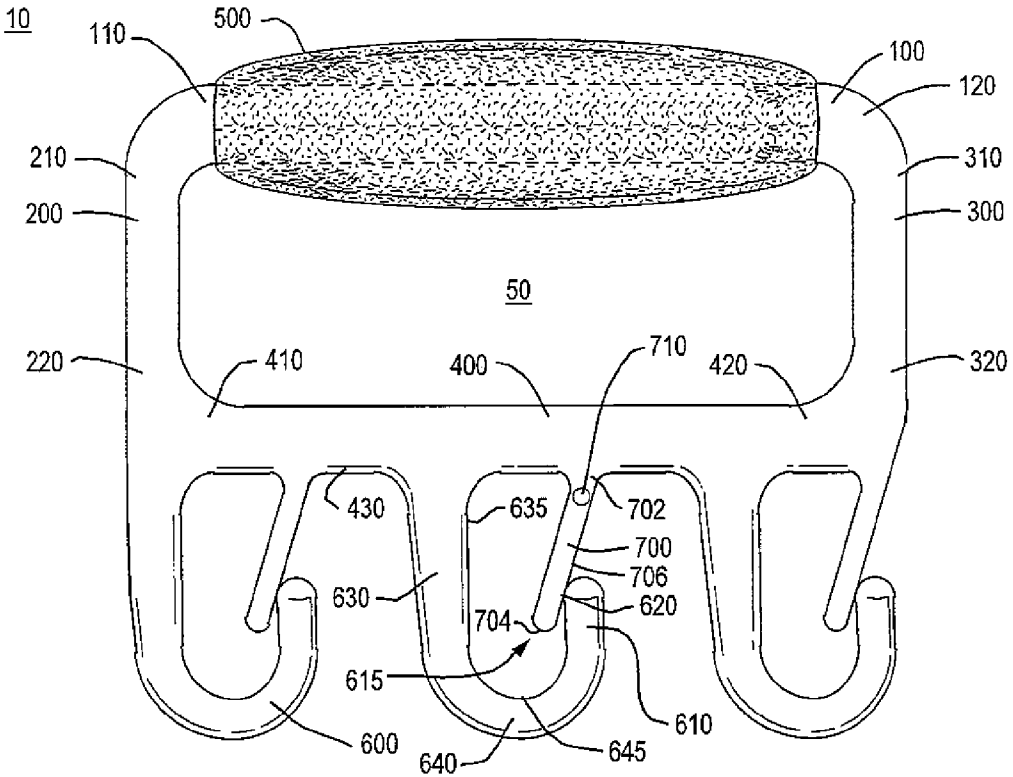
FIG. 1 is a side view of the preferred embodiment of the present invention.
Figure 2:
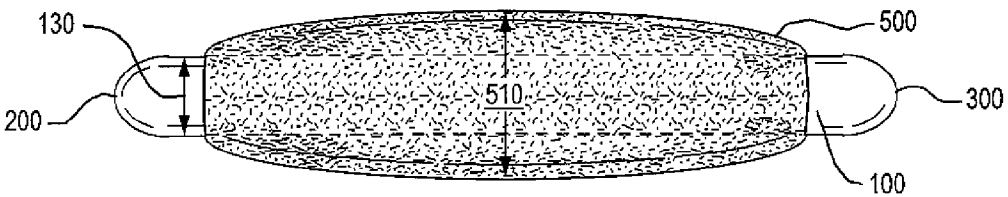
FIG. 2 is a top view of the preferred embodiment of the present invention.

As illustrated in FIGS. 1-3, the present invention is a carrying device 10 that includes a first section 100, a second section 200, and a third section 300. Further, a first end 110 of the first section 100 is integrally connected to a first end 210 of the second section 200, and a second end 120 of the section 100 is integrally connected to a first end 310 of the third section 300.

The carrying device 10 also includes a fourth section 400 having a first end 410 that is integrally connected to the second section 200 at a second end 220, and having a second end 420 that is integrally connected to the third section 300 at a second end 320. When the first section 100, the second section 200, the third section 300, and the fourth section 400 are integrally connected as described, a central opening 50 is formed in the device 10.

The carrying device 10 further includes a plurality of holding members 600 that extend from the fourth section 400 at posterior side 430. Specifically, each holding member 600 extends from the fourth section 400 by a spinal shank 630. Extending outwardly from the spinal shank 630 is a hook arm 640 of the holding member 600. The hook arm 640 extends toward, but does not reach, the posterior side 430 of the fourth section 400. All hook arms 640 are arranged such that no two hook arms 640 face each other. In other words, the hook arms 640 all are oriented such that they face in a common direction.

The lengths of the spinal shanks 630 of the holding members 600, and therefore the distance which separates the hook arms 640 from posterior side 430 may be varied. For example, this length may be about 1.25 inches. As another example, this length may be about 1.75 inches. This length, however, is not limited to being about 1.25 inches or about 1.75 inches. Instead, this length may be any size that permits items to be loaded and unloaded from the holding members 600.

Also extending from the fourth section 400 are a plurality of flexible tines 700, with each flexible tine having upper end 702, lower end 704 and side surface 706. The upper end 702 is joined to the fourth section 440 at the posterior side 430 and is substantially axially aligned with loading end 610 of the holding member 600. The flexible tines 700 are arranged to extend at all times at a non-orthogonal angle from the posterior side 430 of the fourth section 400 toward inner holding face 645 of the hook arm 640, such that the lower end 704 extends beyond inner face 620 to a position 615. In this arrangement, only side surface 706 contacts the holding member 600 at inner face 620. In this arrangement, the carrying device 10 has one flexible tine 700 for every one holding member 600. The lower end 704 of tine 700 is spaced away from the loading end 610 of the holding member 600 while only side surface 706, which is located between upper end 702 and lower end 704 of the tine 700, contacts the holding member 600 at inner face 620 of loading end 610. This establishes a "V" shape at all times characterized and bounded by lower end 704 of tine 700, the tine-holding member contact point at inner face 620, and loading end 610 of the holding member 600 below the inner face 620 spaced from and aligned with lower end 704 of the tine 700. Further, as shown in FIG. 1, the arrangement of the tines 700 with respect to the holding members 600 enables movement of the tine 700 away from the holding member 600, whether a bag is placed on or removed from the hook arm 640, without the possibility of the lower end 704 of the tine becoming wedged on the loading end 610 of the holding member 600.

In the preferred embodiment of the present invention, the first section 100 is integrally connected to the first ends 210 and 310 of the second section 200 and the third section 300, respectively, and the fourth section 400 is integrally connected to the seconds ends 220 and 320 of the second and third sections 200 and 300, respectively. Further, in the preferred embodiment, all of the holding members 600 and the flexible tines 700 are integrally connected to the fourth section 400.

In the preferred embodiment, the first section 100, the second section 200, the third section 300, the fourth section 400, the holding members 600 and the flexible tines 700 all are formed from the same contiguous material. This material should be strong enough to withstand normal use of the device 10. Normal use includes dropping and bumping the device 10, and includes compressing it, such as running over it with an automobile tire. Further, this material should be capable of being manufactured as to have a smooth, or substantially smooth, and non-porous surface finish. This material therefore may be, but is not limited to being, a plastic or a plastic composite. Exemplary materials include, but are not limited to, polypropylene, polyethylene, and composites including these two materials.

The carrying device 10 further includes a handle 500 that is associated with first section 100. In the preferred embodiment of the present invention, the handle 500 entirely, or substantially entirely, surrounds the first section 100 and is made of one or more materials. For example, the handle 500 may be or include a foam material, such as a foam rubber. Examples of foam rubber that may be used include polyurethane, polystyrene, polyethylene, and neoprene. As another example, the handle 500 also may be or include a natural rubber, such as latex. Further, the handle 500 may be or include a natural or synthetic textile material, such as canvas or rayon, or animal product, such as leather. Still further, the handle 500 may be corded or textured in another way to improve gripping. No matter which material is used, or combinations of materials are used, to form the handle 500, the handle 500 should be sufficiently cushioned such as to minimize, if not eliminate, discomfort to the user's hand while using the device to carry heavy loads.

Further, the handle 500 may be irremovably connected to the outer surface of the first section 100 or it may be removably connected to the first section 100. For example, the handle 500 may be irremovably attached to the first section 100 by using an adhesive. As another example, the handle may be fastened to the handle 500 by using a fastening device. Removably connecting the handle 500 to the first section 100 would allow the handle 500 to be more easily cleaned or replaced.

Although the carrying device 10 is durably constructed, the carrying device 10 has a compact design. The handle 500 is selectably manufactured with a width dimension 510 that allows it to be gripped by hands of all sizes, even the smallest or the largest of hands. For example, the width 510 of the handle 500 may be, but is not limited to being, about 2.5 inches. Further, the first horizontal member 100 is of a thickness 130 which is smaller than the width 510 of the handle 500. For example, the thickness 130 may be, but is not limited to being, about 1.75 inches.

FIGS. 2 and 3 show the overall size relationship of the preferred arrangement of the carrying device 10 and its handle 500. The thickness 230 of the second section 200 is essentially equal to the thickness 130 of the first section 100. For example, where the thickness 130 of the first section 100 is about 1.75 inches, the thickness 230 of the second section 200 is about 1.75 inches. Both the third section 300 and the fourth section 400 are preferably of thicknesses which approximate the thicknesses 130 and 230 of the first section 100 and the second section 200. In this arrangement, therefore, the thicknesses of all four sections, 100, 200, 300 and 400, are approximately equal. In addition to being of essentially equal thicknesses, the first section 100 and the fourth section 400 are of essentially the same first length, and the second section 200 and the third section 300 are of the same second length. The first length and the second length may be the same or different.

The flexible tines 700 are preferably formed and arranged such that a particular flexible tine 700 may be flexed in any direction toward or away from the loading end 610 of its corresponding holding member 600. Alternatively, each flexible tine 700 may be flexed only along a linear path between the inner spinal face 635 and loading end 610 of its proximate holding member 600.

The flexible tines 700 also may be of varying flexibility. The flexibility of the flexible tines 700 may be varied by varying their thickness 710 or the choice of material used to form them. For example, the flexible tines 700 having low flexibility may be formed by increasing the thickness 710 of the flexible tines 700. Flexible tines 700 having low flexibility may be preferred, for example, by users of the device who seek maximum protection from accidental unloading of bags from the device. For example, users of the device who carry the device while riding a bicycle on an uneven path may need such maximum protection.

As another example, flexible tines 700 having high flexibility may be formed by reducing their thickness 710. Flexible tine members 700 having low flexibility may be preferred, for example, by users who are frail, such as those having severe arthritis. Such frail users would have an easier time loading and unloading bags from the holding members 600 where the flexible tines 700 are easily flexed.

The only requirement regarding the flexibility of the flexible tine members 700 is that they must be sufficiently flexible as to allow the handles of a bag to be loaded onto the holding member 600 such that the handles of the bag fully clear the flexible tine member-holding member interface at position 615 and be able to contact the holding member 600 at its inner holding face 645.

While the present invention has been described with particular reference to certain embodiments of the carrying device, it is to be understood that it includes all reasonable equivalents thereof as defined by the following appended claims.

What is claimed is:

1. An item carrying device, comprising:

a. a first section having a first end and a second end;

b. a second section having a first end and a second end, wherein the first end of the second section is integrally connected to the first end of the first section;

c. a third section having a first end and a second end, wherein the first end of the third section is integrally connected to the second end of the first section;

d. a fourth section having a first end and a second end, wherein the second end of the second section is integrally connected to the first end of the fourth section, and the second end of the third section is integrally connected to the second end of the fourth section, such that the structure formed by the connections of the first section and the fourth section to both the second section and the third section forms a central opening through which a hand may be inserted;

e. a handle connected to the first section;

f. a plurality of holding members, each having a loading end and an inner holding face, the plurality of holding members being connected to, and extending from, the fourth section such that the loading ends all face in essentially the same direction, and wherein the loading end includes an inner face; and g. a plurality of flexible tines, wherein each one of the plurality of tines has an upper end, a lower end and a side surface located between the upper end and the lower end, wherein the upper end of each one of the plurality of flexible tines is connected to the fourth section such that each flexible tine is substantially axially aligned at its upper end with the corresponding loading end of one of the plurality of holding members, wherein the lower end of each one of the plurality of tines extends at all times at a non-orthogonal angle toward the inner holding face of the corresponding one of the plurality of holding members, and wherein the lower end is spaced away from the loading end of the holding member and only the side surface contacts the holding member at the inner face of the loading end to form a V shape, which V shape is bounded by the lower end, the point of contact between the tine and the holding member at the inner face and loading end below the inner face spaced from and aligned with the lower end of the tine.

2. The item carrying device of claim 1 wherein the first section, the second section, the third section, the fourth section, the plurality of holding members, and the plurality of flexible tines are formed of the same material.

3. The item carrying device of claim 2 wherein the material is plastic or a plastic composite.

4. The item carrying device of claim 3 wherein the plastic is polyethylene, polypropylene, or a composite of polyethylene and polypropylene.

5. The item carrying device of claim 1 wherein the surfaces of the first section, the second section, the third section, the fourth section, the plurality of holding members, and the plurality of flexible tines are substantially smooth.

6. The item carrying device of claim 1 wherein the surfaces of the first section, the second section, the third section, the fourth section, the plurality of holding members, and the plurality of flexible tines are substantially non-porous.

7. The item carrying device of claim 1 wherein the handle is formed from at least one foam material.

8. The item carrying device of claim 7 wherein the at least one foam material is selected from the group consisting of polyurethane, polystyrene, and polyethylene.

9. The item carrying device of claim 1 wherein the handle is textured.

* * * * *